US009076638B2

(12) United States Patent
Sugiyama et al.

(10) Patent No.: US 9,076,638 B2
(45) Date of Patent: Jul. 7, 2015

(54) MASS SPECTROMETER METHOD AND MASS SPECTROMETER

(75) Inventors: Masuyuki Sugiyama, Hino (JP); Yuichiro Hashimoto, Tachikawa (JP); Hideki Hasegawa, Tachikawa (JP); Shuhei Hashiba, Wako (JP); Shun Kumano, Kokubunji (JP)

(73) Assignee: HITACHI-HIGH TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 13/365,355

(22) Filed: Feb. 3, 2012

(65) Prior Publication Data

US 2012/0223223 A1 Sep. 6, 2012

(30) Foreign Application Priority Data

Mar. 4, 2011 (JP) ..... 2011-047101

(51) Int. Cl.
*H01J 49/26* (2006.01)
*H01J 49/00* (2006.01)

(52) U.S. Cl.
CPC ..... *H01J 49/0031* (2013.01); *H01J 49/0045* (2013.01)

(58) Field of Classification Search
CPC ..... B01D 59/44; H01J 49/26
USPC ..... 250/281
See application file for complete search history.

(56) References Cited

U.S. PATENT DOCUMENTS

| | | | | |
|---|---|---|---|---|
| 5,696,376 | A * | 12/1997 | Doroshenko et al. | 250/292 |
| 5,714,755 | A * | 2/1998 | Wells et al. | 250/281 |
| 6,177,668 | B1 | 1/2001 | Hager | |
| 7,014,880 | B2 * | 3/2006 | Wood et al. | 427/69 |
| 7,138,624 | B2 * | 11/2006 | Kato | 250/282 |
| 2006/0141631 | A1 * | 6/2006 | Bondarenko et al. | 436/86 |
| 2006/0148093 | A1 * | 7/2006 | Gygi et al. | 436/173 |
| 2009/0134321 | A1 * | 5/2009 | Hoyes | 250/282 |
| 2010/0032558 | A1 | 2/2010 | Bystrom et al. | |
| 2010/0148054 | A1 | 6/2010 | Haddon et al. | |

FOREIGN PATENT DOCUMENTS

| | | | |
|---|---|---|---|
| JP | 2001-147216 | A | 5/2001 |
| WO | 2009/023361 | A2 | 2/2009 |

OTHER PUBLICATIONS

A. Keil et al, "Ambient Mass Spectrometry with a Handheld Mass Spectrometer at High Pressure", Anal. Chem., 2007, 79, pp. 7734-7739.

"Tandem-in-Time Mass Spectrometry" In: J. Throck Watson and O. David Sparkman: "Introduction to mass spectrometry. Instrumentation, applications, and strategies for data interpretation, 4th ed," Jul. 23, 2008, Springer, Berlin, DE, XP002681376, ISBN: 978-0-470-51634-8 pages 192-196.

* cited by examiner

*Primary Examiner* — Phillip A Johnston
(74) *Attorney, Agent, or Firm* — Mattingly & Malur, PC

(57) ABSTRACT

A variation in an ionization efficiency and the amount of sample which is introduced into an ion trap is corrected and quantified. Ions of an internal standard and ions of a sample are trapped in the ion trap at the same time, and a concentration of the sample is quantified according to an intensity of the ions of the internal standard which are mass-selectively ejected, and an intensity of fragment ions of the sample.

14 Claims, 7 Drawing Sheets

MASS SPECTROMETER METHOD AND MASS SPECTROMETER

CLAIM OF PRIORITY

The present application claims priority from Japanese patent application JP 2011-047101 filed on Mar. 4, 2011, the content of which is hereby incorporated by reference into this application.

FIELD OF THE INVENTION

The present invention relates to a mass spectrometric method and a mass spectrometer.

BACKGROUND OF THE INVENTION

In a mass spectrometer, a method in which ions generated at an atmospheric pressure or in a low vacuum are introduced into a mass analyzing part requiring a high vacuum of $10^{-1}$ Pa or lower is an important technique for realizing a high sensitivity.

Analytical Chemistry, 2007, 79, 20, 7734-7739, Adam Keil, et al. discloses a method in which a thin capillary is coupled directly between an atmospheric ion source and a mass analyzing part of a high vacuum. In this method ions are introduced into the mass analyzer through the thin capillary.

U.S. Pat. No. 6,177,668 discloses a differential pumping system that is most generally used in mass spectrometry. In this system, a single or multiple differential pumping chambers each having an intermediate pressure is installed between the atmospheric ion source and a vacuum chamber, and gas is evacuated from those differential pumping chambers by a pump to enable ions generated at the atmospheric pressure to be introduced remarkably efficiently as compared with Analytical Chemistry, 2007, 79, 20, 7734-7739, Adam Keil, et al.

WO 2009/023361 discloses a method in which a pulse valve is installed between the atmospheric ion source and a high vacuum unit in which the mass analyzing part is equipped, and open/close operation of the pulse valve is temporally controlled. When the pulse valve is opened, ions are introduced into the mass analyzing part of the high vacuum unit, and then after the pulse valve is closed to reduce a pressure in the high vacuum unit, the mass analyzing part is operated. As a result, the amount of introduced ions can be increased infinitely more than that of Analytical Chemistry, 2007, 79, 20, 7734-7739, Adam Keil, et al.

Japanese Unexamined Patent Application Publication No. 2001-147216 discloses a method in which a material having substantially the same ionization efficiency as that of a sample, for example, a stable, rare and isotopically substituted material of the sample is added with a constant concentration as the internal standard to measure the amount of ions.

SUMMARY OF THE INVENTION

An object of the present invention is to conduct quantification by MSn measurement in a device configuration in which the sensitivity can be maintained even in the number of evacuation pumps necessary for downsizing or a pump having a low evacuation speed.

In the configuration of Analytical Chemistry, 2007, 79, 20, 7734-7739, Adam Keil, et al., because gas is introduced into the high vacuum unit installed in the mass analyzing part through the capillary, the amount of introducible ions is small, and the sensitivity is remarkably deteriorated. Also, there is no disclosure of a method in which a variation in the ionization efficiency or the amount of sample which is introduced into an ion trap is corrected to conduct the quantification.

In the configuration of U. S. Pat. No. 6,177,668, the differential pumping is conducted between the high vacuum unit installed in the mass analyzing part and the ion source of the atmospheric pressure to increase the amount of introducible ions. On the other hand, multiple large-sized pumps for conducting the differential pumping are required.

As in the method disclosed in WO 2009/023361, when samples are intermittently introduced into the ion trap with the aid of the valve to conduct the MSn measurement, the amount of ions of the sample which are introduced into the ion trap is varied for each measurement sequence. For that reason, the concentration of the sample cannot be quantified from an intensity of the fragment ions of the sample which is measured according to the MSn measurement. Also, there is a need to correct the variation in the ionization efficiency or the amount of sample which is introduced into the ion trap to conduct the quantification. However, there is not disclosure of this manner.

Also, in the method of Japanese Unexamined Patent Application Publication No. 2001-147216, the variation in the ionization efficiency and the intensity which is caused by attachment to a piping can be corrected. However, the variation in the amount of sample which is introduced for one measurement sequence of the ion trap cannot be corrected.

The ions of the internal standard and the ions of the sample are trapped in the ion trap at the same time, and the concentration of the sample is quantified according to an intensity of the ions of the internal standard that is mass-selectively ejected, and an intensity of the fragment ions of the sample.

According to one aspect of the present invention, there is provided a mass spectrometric method including the steps of: ionizing a sample and a internal standard having a known concentration in an ion source; introducing sample ions and internal standard ions into an ion trap; accumulating the sample ions and the internal standard ions in the ion trap; mass-selectively ejecting and detecting the internal standard ions from the ion trap; isolating precursor ions of the sample ions in the ion trap; dissociating the precursor ions; mass-selectively ejecting and detecting the dissociated precursor ions from the ion trap; and calculating a concentration of the sample on the basis of an intensity of the detected internal standard ions and an intensity of the dissociated sample ions.

According to another aspect of the present invention, there is provided a mass spectrometer including: an ion source that ionizes a sample and a internal standard having a known concentration; an ion trap that accumulates and mass-selectively ejects sample ions and internal standard ions which are generated by the ion source; a detector that detects ions ejected from the ion trap; an open/close mechanism that intermittently introduces the ions into the ion source or the ion trap; and a control unit that controls the ion trap and the open/close mechanism, and calculates a concentration of the sample on the basis of an intensity of the internal standard ions and an intensity of the sample ions dissociated in the ion trap.

The variation in the ionization efficiency and the amount of the sample which is introduced into the ion trap can be corrected to conduct the quantification.

DETAILED DESCRIPTION OF THE PREFERRED EMBODIMENTS

First Embodiment

Figure 1A:
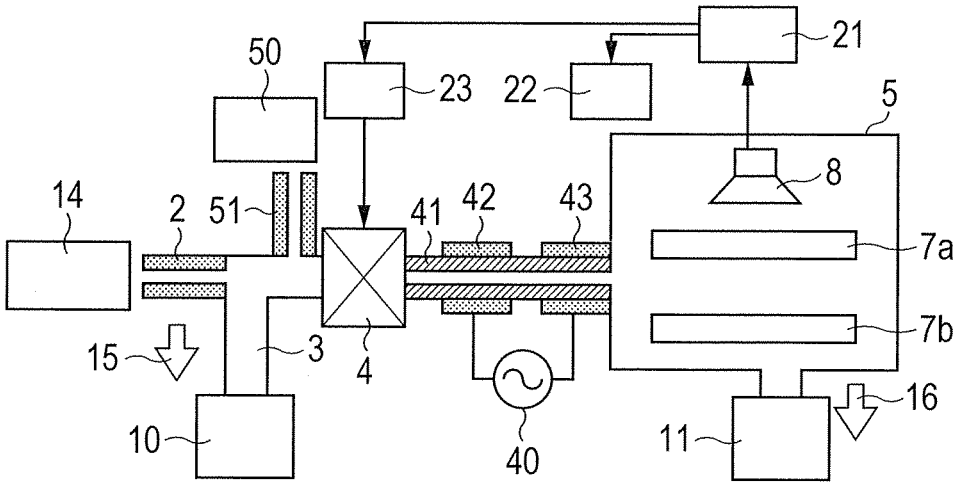
FIGS. 1A and 1B are diagrams illustrating a configuration of a first embodiment.
Figure 1B:
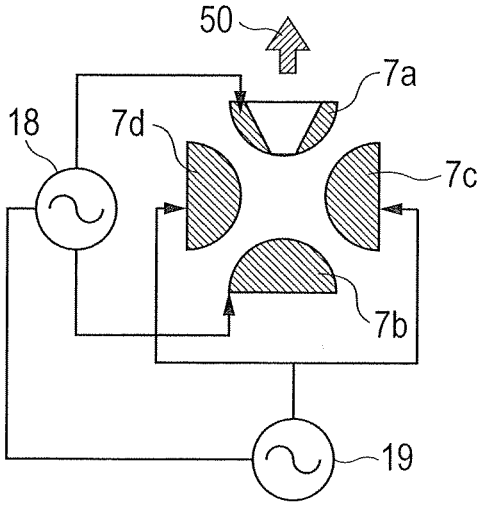

FIGS. 1A and 1B are an example of a mass spectrometer. A unit of a sample to be measured is vaporized by a vaporizer 14 including a heater and a sprayer, and introduced into a before-valve evacuation area 3 through a capillary 2. Also, an internal standard is vaporized by a vaporizer 50, and introduced into the before-valve evacuation area 3 through a capillary 51. In this example, the internal standard is a material having substantially the same ionization efficiency as that of an object to be measured, for example, a stable, rare and isotopically substituted material of the sample. The internal standard may be vaporized and introduced by the vaporizer 14 together with the sample. However, it is preferable that the sample is vaporized by the vaporizer 50 different from the vaporizer 14 to always introduce the internal standard having a given flow rate and concentration into the before-valve evacuation area 3 because the intensity of the internal standard is stabilized to enable accurate measurement.

The sample and the internal standard which have been vaporized are introduced into the before-valve evacuation area 3, and then introduced into a dielectric capillary 41 made of dielectric such as glass, ceramic, or plastic together with a surrounding gas when a valve 4 is opened. An electrode 42 and an electrode 43 are disposed around an outer side of the dielectric, and a voltage that is about 1 to 100 kHz in frequency and about 2 to 5 kV in voltage is applied between the electrode 43 and the electrode 42 to progress dielectric barrier discharge. The vaporized molecules are introduced into the discharge area to generate molecular ions of the sample.

The valve 4 has a function of opening and closing a flow channel. The valve 4 is not a simple open/close mechanism, but can control intermittent introduction or non-introduction of gas like a pinch valve or a slide valve. Even when the gas is intermittently introduced or non-introduced under the control, the amount of a sample which is introduced for each sequence is not always the same. Also, in this case, there is a possibility that the ionization efficiency is varied. Accordingly, a variation in the amount of sample and the ionization efficiency can be corrected by ionizing the internal standard having the known concentration together with the sample.

The ions generated in the dielectric capillary 41 are introduced into an analyzing chamber 5 in which a mass analyzing part 7 and a detector 8 are disposed. Gas is evacuated from the analyzing chamber 5 by an evacuation pump 11 such as a molecular pump or an ion getter pump (an evacuation direction of the evacuation pump 11 is indicated by reference numeral 16).

Ions introduced into the analyzing chamber 5 are introduced into the mass analyzing part 7. In the first embodiment, for description of the measurement sequence, a linear ion trap mass spectrometer will be exemplified. The linear ion trap is configured by a multiple, for example, four quadruple rod electrodes (7*a*, 7*b*, 7*c*, and 7*d*). A high frequency voltage 19 is applied to the four quadruple rod electrodes 7 so that the facing rods (7*a* and 7*b*, 7*c* and 7*d*) are in phase, and the adjacent rods are reverse in phase. There is known that an optimum value of the trap RF voltage 19 is different according to an electrode size or a measurement mass range. Typically, the trap RF voltage 19 that is about 0 to 5 kV (0 to peak) in amplitude and about 500 kHz to 5 MHz in frequency is used. Also, when negative ions are measured by application of the high frequency voltage, a positive offset voltage may be applied to the four quadruple rod electrodes 7, and when negative ions are measured, a negative offset voltage may be applied to the four quadruple rod electrodes 7. The application of the high frequency voltage 19 enables the ions to be trapped in a space within the four quadruple rod electrodes 7.

Also, a supplemental AC voltage 18 is applied between a pair of facing rod electrodes (between 7*a* and 7*b*). As the supplemental AC voltage, typically, a voltage having a single frequency that is about 0 to 50 V (0 to peak) in amplitude and about 5 kHz to 2 MHz in frequency, or a superimposed waveform of those multiple frequency components. With the application of the supplemental AC voltage 18, only the ions of a specific mass number can be selected from the ions trapped within the four quadruple rod electrodes 7, and the other ions can be excluded therefrom. Also, the ions of the specific mass number can be dissociated, or mass scanning for mass-selectively ejecting the ions can be conducted. As the mass scanning manner, in this example, the supplemental AC voltage 18 is applied between the pair of electrodes. As another example, there is a manner in which the supplemental AC voltage 18 having the same potential is applied between the pair of rod electrodes (between 7*a* and 7*b*).

The ions mass-selectively ejected are converted into an electric signal by the detector 8 configured by an electron multiplier, a multi-channel plate, or a conversion dynode, an electron multiplier, and an electron multiplier, transmitted into a control unit 21, and stored in a storage unit within the control unit 21. The control unit 21 has not only the functions of storing and converting those pieces of information, but also a function of controlling a control power supply 22 that controls the respective electrodes, and a valve power supply 23. In FIG. 1, the respective capillaries are connected between the valve and the ion source, and between the valve and the vacuum chamber. Alternatively, the capillaries may be replaced with orifices.

A pressure within the analyzing chamber 5 is 1 Pa or higher (typically, about 10 Pa) when the valve is opened. On the other hand, the excellent operation of the linear ion trap and the detector 8 such as the electron multiplier becomes enabled when the pressure within the analyzing chamber 5 is 0.1 Pa or lower. Therefore, measurement is conducted by a measurement sequence illustrated in FIGS. 2A and 2B. An example of the measurement sequence includes seven steps of accumulation, pumping wait, mass selective extraction of internal standard ions, isolation, dissociation, mass selective extraction of sample fragment ions to be measured, and ejection.

In the accumulation step, the valve is opened to introduce a sample gas containing the internal standard and the sample into an ionization chamber, and traps internal standard ions and sample ions to be measured which are generated in the ionization chamber in the ion trap at the same time.

In the pumping step, waiting is conducted until a pressure within the analyzing chamber 5 is reduced to a pressure of 0.1 Pa or lower at which the ions can be measured. The sensitivity is improved more as the amount of sample gas introduced in the accumulation step is larger. However, the pumping wait time becomes longer, and a duty cycle is deteriorated.

In the mass selective extraction of the internal standard ions, the internal standard ions are mass-selectively ejected while the sample ions to be measured are trapped within the ion trap. The ejected sample ions to be measured are detected by the detector 8, and the ion intensity is saved in the control unit 21. As illustrated in FIG. 2, the supplemental AC voltage of the resonance frequency is applied to the internal standard ions as illustrated in FIG. 2 whereby the internal standard ions can be mass-selectively ejected.

A time required for ejecting the internal standard ions is about 0.1 to 10 ms. Also, the trap RR voltage amplitude or the supplemental AC voltage frequency is about 0.1 to 10 ms may be scanned mainly under the resonance condition of the internal standard ions. When the ions are ejected with the fixed resonance condition of the internal standard ions without scanning, the time required for extraction becomes shorter. On the other hand, when scanning is conducted, even if the resonance condition is not met due to an influence of space charge, the internal standard ions can be ejected, and are robust. Also, fitting starts from a peak configuration of the mass spectrum, or information processing such as subtraction of a signal of background is conducted, thereby enabling a precise intensity to be obtained.

Figure 2A:
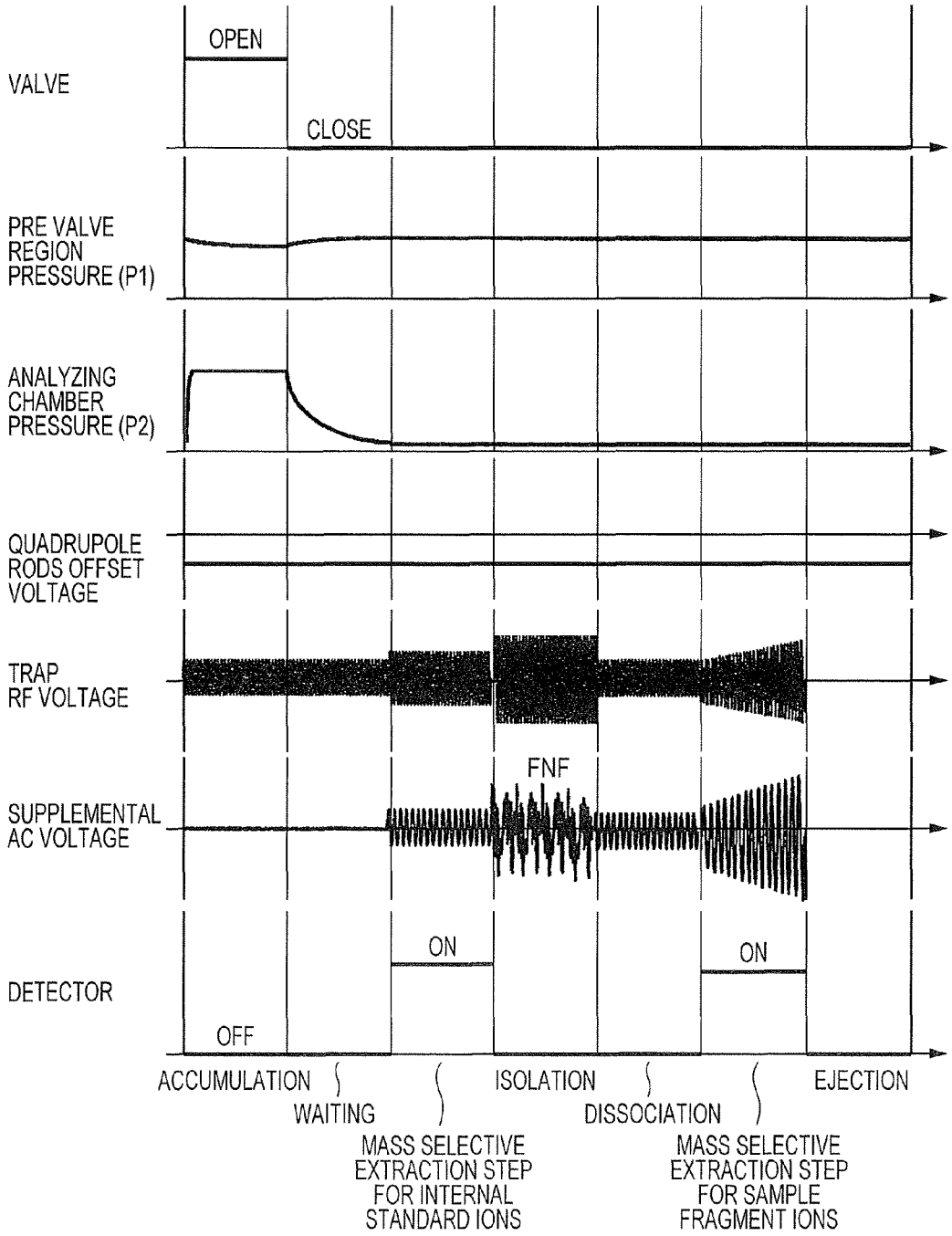
FIG. 2A is a diagram illustrating a measurement sequence of the first embodiment.
Figure 2B:
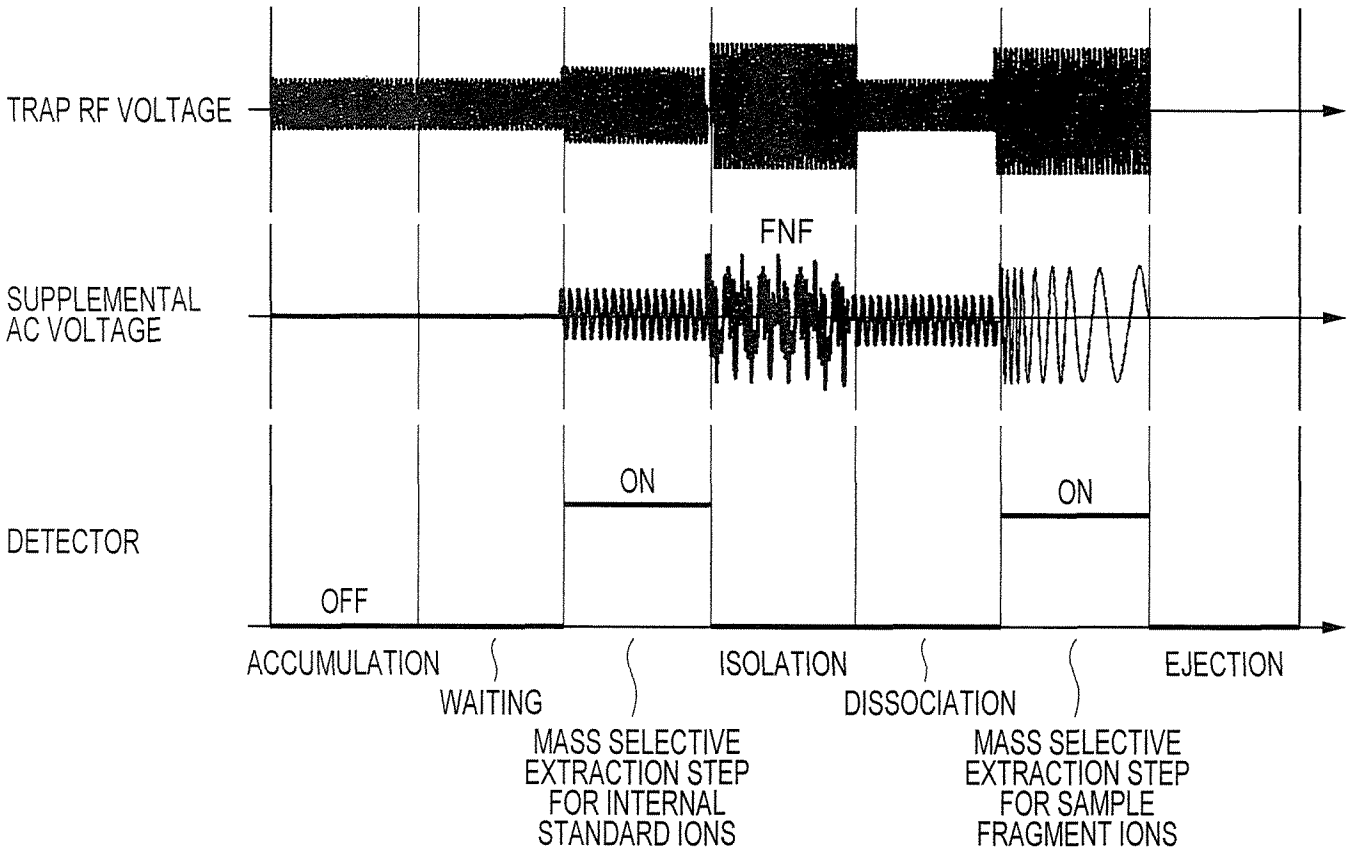
FIG. 2B is a diagram illustrating a measurement sequence of the first embodiment.

In the isolation step, among the ions accumulated within the ion trap whose pressure has been reduced to 0.1 Pa or lower in the air evacuation step, only precursor ions of the sample are allowed to remain by excluding the ions other than the precursor ions of the sample. FIGS. 2A and 2B exemplify a method of applying a superimposed waveform of the plural frequencies which is called "FNF" as the supplemental AC voltage. The ions resonated by the FNF are ejected to the external of the ion trap, and only the precursor ions of the sample remain within the trap. As other methods, a quadruple DC voltage can be applied so that the facing rods become in phase, and the adjacent rods become reverse in phase, the frequency of the supplemental AC voltage can be swept in a range other than the resonance condition of the precursor ions of the sample, or the amplitude of the trap RF voltage can be changed to implement the isolation.

In the dissociation step, the precursor ions of the sample which are selected within the ion trap are dissociated by application of the supplemental AC voltage. The ions resonant with the supplemental AC voltage collide with a buffer gas within the trap in a multiple manner, and are dissociated to generate fragment ions. A preferred pressure of the buffer gas ranges from about 0.01 Pa to 1 Pa. The gas that remains in the analyzing chamber may be used, or an additional gas can be introduced into the ion trap (not shown). As an advantage of introducing the additional gas, measurement with a high reproducibility can be conducted by controlling a gas pressure with a high precision.

In the mass selective extraction of the sample fragment ions of the sample, the fragment ions of the sample within the ion trap are mass-selectively ejected. FIG. 2A discloses a method for changing the amplitude of the trap RF voltage while applying the supplemental AC voltage having a constant frequency as an example. In the method, resonant ions are sequentially ejected in the order from the lower mass number to the higher mass number, and detected by the detector 8.

The amplitude value of the trap RF voltage and the mass number of the ejected ions are primarily defined so that the mass spectrum can be acquired from the mass number of the detected ions and the amount of signal thereof. As the other mass scanning methods, as illustrated in FIG. 2B, there is a method in which the amplitude of the trap RF voltage is maintained constantly, and the frequency of the supplemental AC voltage is swept. Also, the trap RF voltage amplitude and the frequency of the supplemental AC voltage may be fixed to a range of from about 0.1 to 10 ms as the resonance condition of the respective fragment ions for extraction.

Figure 3:
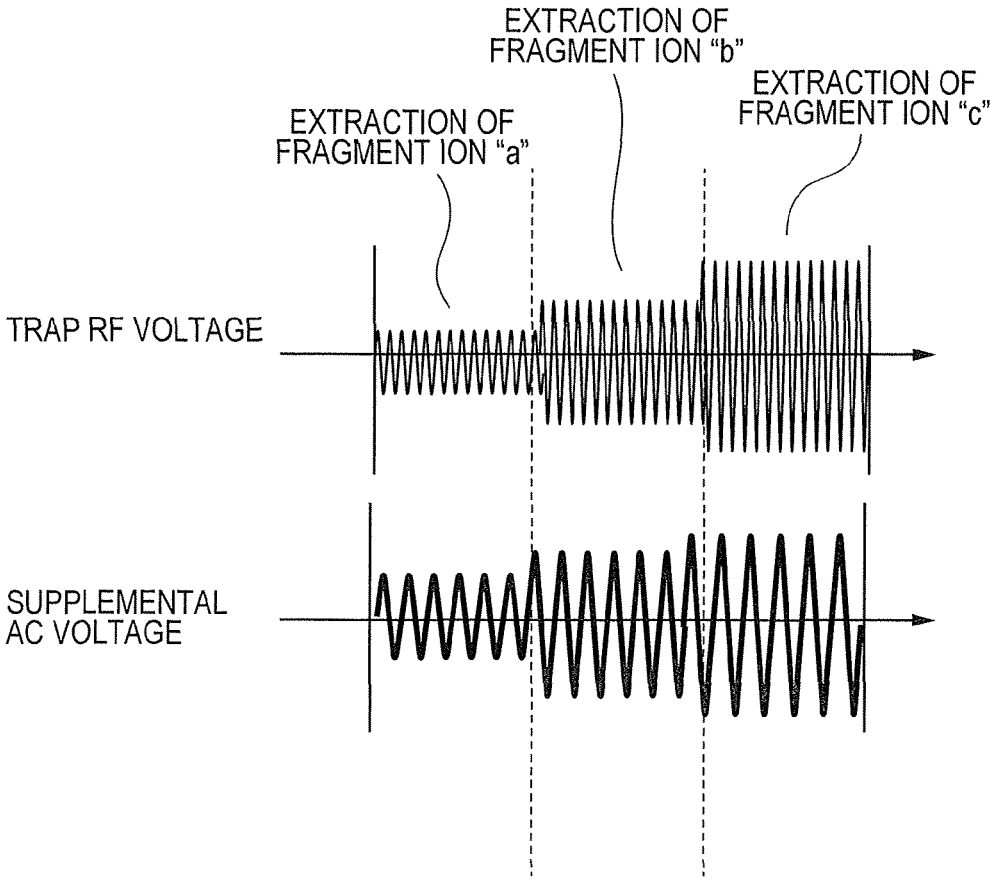
FIG. 3 is a diagram illustrating mass selective extraction operation.

FIG. 3 illustrates an example in which the trap RF voltage and the supplemental AC voltage are controlled when the frequencies of the trap RF voltage and the supplemental AC voltage are fixed, and fragment ions a, b, and c (a<b<c in the magnitude of mass) are sequentially ejected. Even in this method, the mass selective extraction can be conducted.

In the ejection step, the voltage amplitude of the trap RF voltage is set to 0, and all of the ions that remain within the trap are excluded.

In the mass selective extraction step of the internal standard ions and the mass selective extraction step of the sample fragment ions to be measured, there is a need to turn on a voltage across the detector. Because a high voltage requiring time for stabilization is usually used for the voltage of the detector, the voltage may remain on in the isolation step or the dissociation step. The intensity of the fragment ions of the sample which is measured in the mass selective extraction step of the sample ions to be measured is saved in the control unit 21. When multiple MS/MS analyses (MSn) is conducted, the isolation step and the dissociation step may be repeated plural times.

Subsequently, a description will be given of a case in which the concentration of the sample is quantified according to a ratio of the ion intensity of the internal standard which is measured in the mass selective extraction step of the internal standard ions to the ion intensity of the fragment ions of the sample which is measured in the mass selective extraction step of the fragment ions of the sample. Hereinafter, a specific example of that quantification will be described.

An intensity Ii of the internal standard ions is represented by an expression of (Ex. 1), and proportional to an ionization efficiency $\alpha i$, an introduction amount S of gas introduced from the valve in each measurement sequence, the internal standard concentration Ni, and a detection efficiency $\beta$ of the ion trap.

$$Ii=Ni\times\alpha i\times S\times\beta \quad \text{(Ex. 1)}$$

On the other hand, the intensity Is of the fragment ions of the sample is proportional to an ionization efficiency $\alpha s$, an introduction amount S of the gas introduced from the valve in each measurement sequence, a concentration Ns of the sample, a detection efficiency $\beta$ of the ion trap, and a dissociation efficiency $\gamma s$.

$$Is=Ns\times\alpha s\times S\times\beta\times\gamma s \quad \text{(Ex 2)}$$

Accordingly, the concentration of the sample is represented by the following expression using the ratio of the intensity Is of the fragment ions of the sample to the intensity Ii of the internal standard ions.

$$Ns=(Is/Ii)\times(Ni/C) \quad \text{(Ex. 3)}$$

where $$C=\gamma s\times\alpha s/\alpha i \quad \text{(Ex. 4)}$$

C can be regarded as a constant, and as represented by (Ex. 5), the internal standard of the known concentration Ni' and the sample of the known concentration Ns' are measured in advance, and the intensity ratio of the internal standard ions to the fragment ions of the sample is obtained, thereby being capable of determining the constant C.

$$C=(Is\times Ni')/(Ns'\times Ii) \quad \text{(Ex. 5)}$$

In this example, the constant C is measured for each of the sample, the internal standard, and the fragment ions, and saved in a database of the control unit in advance. Also, as another method of obtaining the constant C other than the above method, there is a method in which the precursor ions of the internal standard having a known concentration and the sample having a known concentration are measured in advance, and the ratio of the signal intensities is obtained to determine the ratio ($\alpha s/\alpha i$) of the ionization efficiency, and the dissociation efficiency $\gamma$ is determined according to the intensities of the precursor ions and the fragment ions of the sample.

As described above, the concentration Ns of the sample can be obtained by substituting, into (Ex. 3), values of the ratio of the intensity Is of the fragment ions of the sample to the intensity Ii of the internal standard, the concentration Ni of the internal standard, the constant C saved in the database of the control unit, thereby being capable of obtaining the concentration Ns of the sample.

When multiple fragment ions of the sample are provided, each fragment ion is corrected as described above with the result that the sample can be precisely quantified.

Second Embodiment

Figure 4:
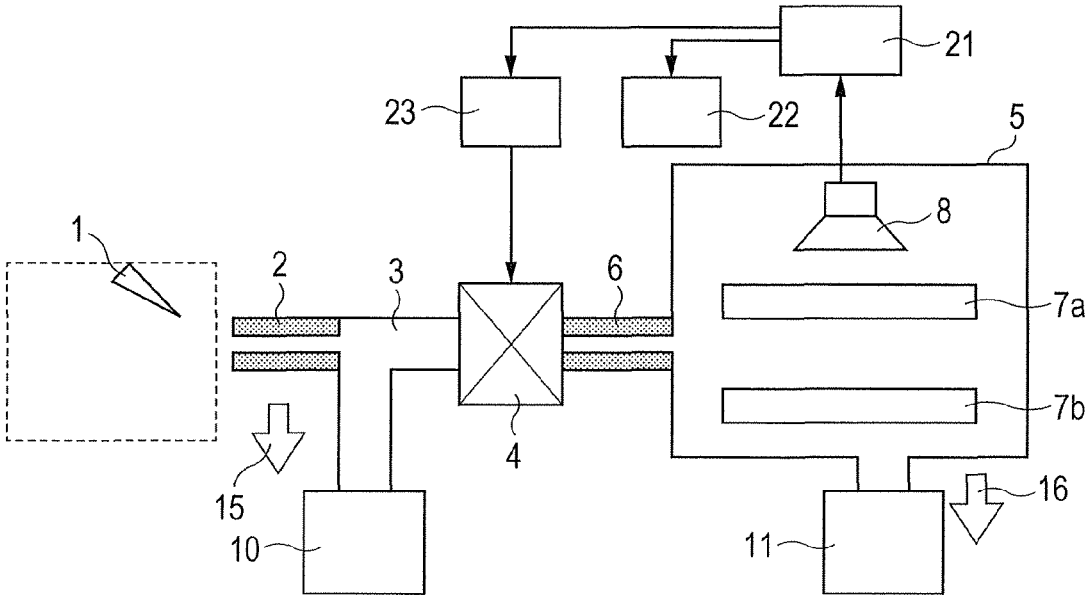
FIG. 4 is a diagram illustrating a configuration of a second embodiment.

FIG. 4 illustrates another configuration example of the mass spectrometer. The ions generated by an atmospheric pressure ion source 1 such as an atmospheric pressure chemical ionization or an electrospray ion source pass through the capillary 2 together with a surrounding gas, and are then introduced into the before-valve evacuation area 3. The internal standard is ionized by the atmospheric pressure ion source 1 together with the sample, passes through the capillary 2, and is introduced into the before-valve evacuation area 3. Gas is evacuated from the before-valve evacuation area 3 by an evacuation pump 10 such as a diaphragm pump or a rotary pump so that a pressure of the before-valve evacuation area 3 becomes about 100 to 10,000 Pa (an evacuation direction of the evacuation pump is indicated by reference numeral 15). If a conductance of the capillary 2 is adjusted so that the highest pressure in the analyzing chamber in the accumulation step of FIG. 2 falls within an operation pressure range of the evacuation pump 11, the evacuation pump 10 may not be provided.

The valve 4 is disposed downstream of the before-valve evacuation area 3, and conducts the open/close operation by the valve power supply 23. The ions that have passed through the valve 4 pass through a capillary 6, and are introduced into the ion trap. The structure of the ion trap and the measurement sequence can be identical with those in the first embodiment. A different from the first embodiment resides in that the ions pass through the valve after ionization. As compared with the first embodiment, the sensitivity is deteriorated due to an influence of loss of the ions generated when the ions go through the valve or the capillary. On the other hand, there is advantageous in that a variety of ion sources can be used, and the maintenance and exchange of the ion sources are easy.

Third Embodiment

Figure 5:
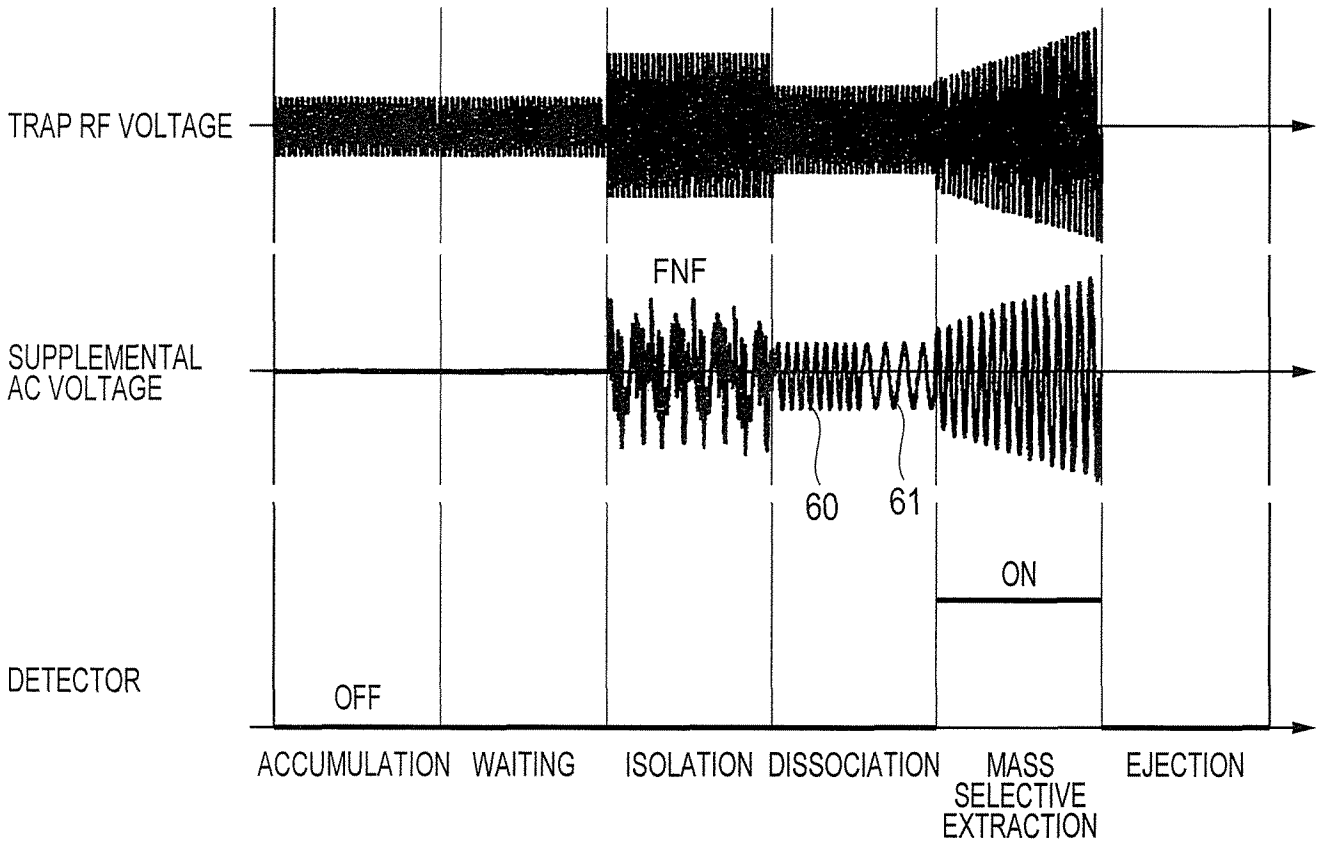
FIG. 5 is a diagram illustrating a measurement sequence of a third embodiment.

FIG. 5 illustrates an example of the measurement sequence. A configuration of the mass spectrometer can be identical with that of the first or second embodiment. Also, the valve open/close, the before-valve evacuation area pressure, and the analyzing chamber pressure may be controlled in the same manner as that of FIG. 2. In the isolation step, the FNF is applied, the precursor ions of the internal standard and the precursor ions of the sample are allowed to remain in the trap, and the other ions are excluded. In the dissociation step, the supplemental AC voltages of the resonant frequencies are applied to the precursor ions of the internal standard and the precursor ions of the sample to dissociate the precursor ions of the internal standard and the sample. As the supplemental AC voltage, the superposition of both the resonant frequencies may be applied, or the respective resonant frequencies may be sequentially applied as illustrated in FIG. 5.

In the mass selective extraction step of the fragment ions, the fragment ions of the internal standard and the sample are mass-selectively ejected, and detected by the detector 8. The fragment ion intensities of the internal standard and the sample are saved in the control unit 21.

The intensity Ii' of the fragment ions of the internal standard is proportional to an ionization efficiency $\alpha i$, the introduction amount S of the gas introduced from the valve in each measurement sequence, a concentration Ni of the internal standard, a dissociation efficiency $\gamma i$, and a detection efficiency $\beta$ of the ion traps.

$$Ii'=Ni\times\alpha i\times S\times\beta\times\gamma i \quad \text{(Ex. 6)}$$

In this case, the concentration Ns of the sample is obtained from (Ex. 6) and (Ex. 2) by the following expression.

$$Ns=(Is/Ii')\times(Ni/C') \quad \text{(Ex. 7)}$$

where $$C'=(\gamma s\times\alpha s)/(\gamma i\times\alpha i) \quad \text{(Ex. 8)}$$

A constant C' can be determined by measuring an internal standard N' of a known concentration and a sample Ns' of a known concentration in advance, and obtaining the intensity ratio of the fragment ions of the internal standard and the sample.

$$C'=(Is\times Ni')/(Ns'\times Ii') \quad \text{(Ex. 9)}$$

The constant C' is measured for each of the sample, the internal standard, and the fragment ions and saved in the database of the control unit in advance, and the constant C' and an intensity ratio (Is/Ii') of the fragment ions of the internal standard and the sample are substituted into (Ex. 7), thereby enabling the concentration Ns of the sample to be obtained.

Also, instead of the fragment ions of the internal standard, the intensity of the precursor ions of the internal standard can be corrected as Ii'. In this case, in the dissociation step, the supplemental AC voltage of the resonance frequency of the precursor ions of the internal standard may not be applied.

As compared with the first embodiment, the third embodiment has such an advantage that the control is simple because the mass selective extraction step is small. However, if the property of the isolation step and the dissociation step is largely different between the internal standard and the sample, there is a possibility that a quantitative value is different.

Fourth Embodiment

Figure 6:
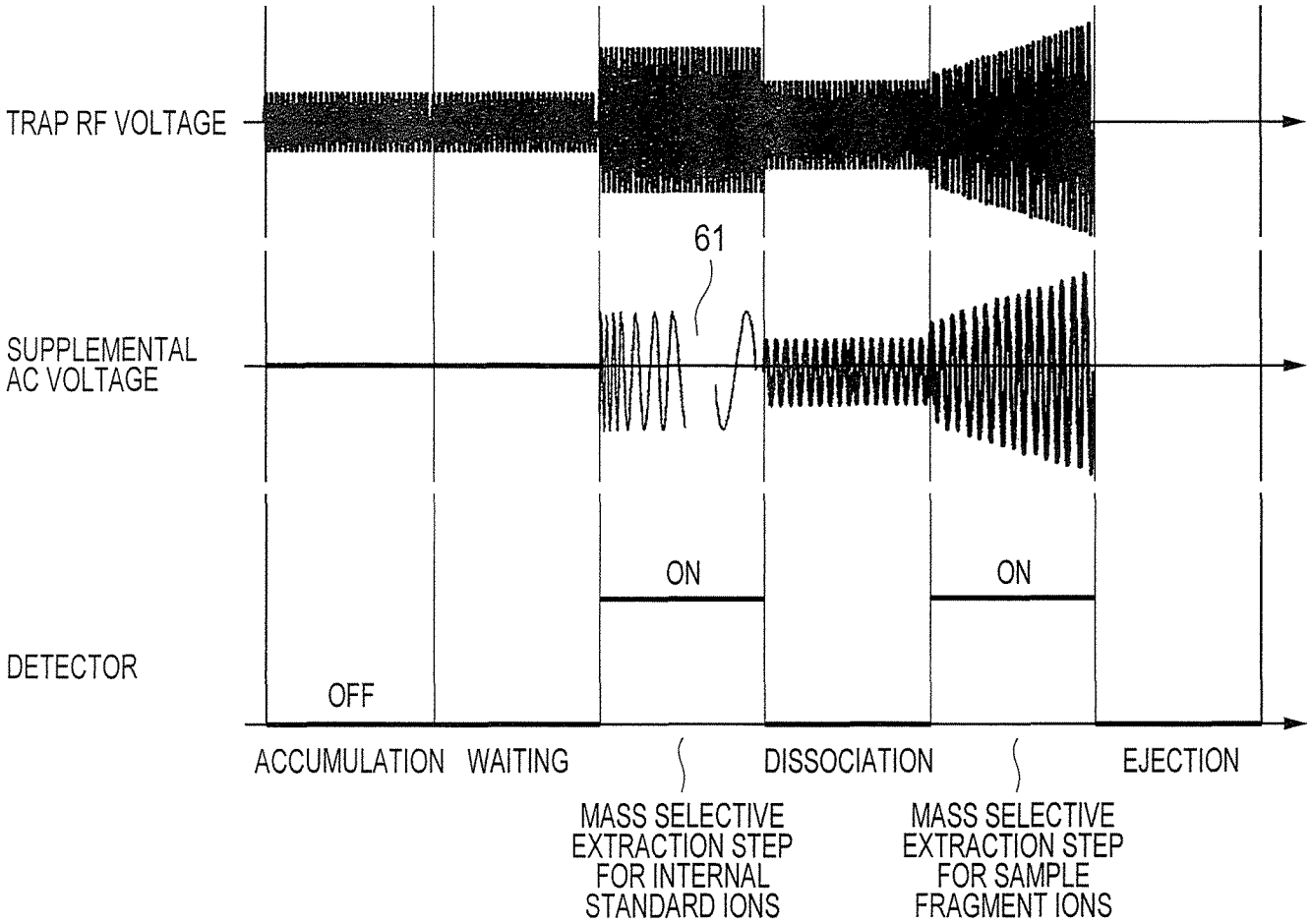
FIG. 6 is a diagram illustrating a measurement sequence of the fourth embodiment.

Subsequently, an example in which isolation is conducted during mass scanning will be described. FIG. 6 illustrates a measurement sequence. A configuration of the mass spectrometer can be identical with that of the first or second embodiment. Also, the valve open/close, the before-valve evacuation area pressure, and the analyzing chamber pressure may be controlled in the same manner as that of FIG. 2.

In the mass selective extraction step of the internal standard, a frequency of the supplemental AC voltage is scanned. At a moment when scanning reaches a condition that resonates with the mass number of the precursor ions of the sample, the amplitude of the supplemental AC voltage is temporarily set to 0 (61), the other ions can be mass-selectively ejected while the precursor ions of the sample remain trapped. The ions ejected from the ion trap are detected by the detector 8, and the intensity is saved in the control unit 21. The method of the measurement sequence and the quantification after the mass selective extraction step of the internal standard is identical with that in the first embodiment.

In the fourth embodiment, because there is a need to scan an overall mass range in which the ions exist in the mass selective extraction step of the internal standard, it takes more time than that when isolation is conducted by the FNF. On the other hand, because the mass spectrum except for the precursor ions of the sample can be obtained, a variety of information other than the ion intensity of the internal standard can be obtained from the mass spectrum. For example, when multiple samples to be measured is provided, if one sample is subjected to MSn measurement in the measurement sequence of the first embodiment, information related to another sample is not obtained. However, in the fourth embodiment, information on the intensity of the precursor ions of another sample is obtained. This is useful in a case where a system in which the concentration of the sample is varied with time is measured. In particular, in the configuration in which gas is intermittently introduced into the analyzing chamber 5 by the aid of the valve 4, the configuration of the fourth embodiment has a great advantage because the time required for the pumping wait step is long.

What is claimed is:

1. A mass spectrometric method comprising:

ionizing a sample and an internal standard having a known concentration in an ion source;

introducing sample ions and internal standard ions into an ion trap;

accumulating the sample ions and the internal standard ions in the ion trap at the same time;

mass-selectively ejecting and detecting the internal standard ions from the ion trap for each accumulating step of a measurement sequence of the ion trap, where the sample ions have been accumulated in the ion trap;

and thereafter, isolating precursor ions from the sample ions in the ion trap;

dissociating the precursor ions to generate fragment ions;

mass-selectively ejecting and detecting the fragment ions from the ion trap for each accumulating step of the measurement sequence of the ion trap; and calculating a concentration of the sample on the basis of an intensity of the detected internal standard ions and an intensity of the dissociated fragment ions of the sample, where the internal standard ions and the sample ions are accumulated at the same accumulating step of the measurement sequence of the ion trap.

2. The mass spectrometric method according to claim 1, further comprising the step of gasifying the sample and the internal standard, wherein a vaporized sample and internal standard are intermittently introduced into the ion source.

3. The mass spectrometric method according to claim 1, wherein gas is intermittently introduced into the ion trap.

4. The mass spectrometric method according to claim 1, wherein an amplitude of a high frequency voltage or a frequency of a supplemental AC voltage which are applied to the ion trap is scanned under a condition that resonates with the internal standard resonates to mass-selectively eject the internal standard ions from the ion trap.

5. The mass spectrometric method according to claim 4, wherein a period that does not satisfy the condition that resonates with the precursor ions of the sample is included during a period where the scanning is conducted under the resonance condition of the internal standard ions.

6. The mass spectrometric method according to claim 1, further comprising the step of isolating and dissociating the precursor ions of the sample and the internal standard which are accumulated in the ion trap from each other, wherein the step of mass-selectively ejecting and detecting the internal standard ions from the ion trap detects the fragment ions of the internal standard, and wherein a concentration of the sample is quantified on the basis of the intensity of the dissociated fragment ions of the internal standard and the intensity of the dissociated fragment ions of the sample.

7. The mass spectrometric method according to claim 1, wherein the concentration of the sample is quantified according to the intensity ratio of the internal standard ions to the fragment ions of the sample, and a constant determined on the basis of the concentrations of the internal standard ions and the fragment ions.

8. A mass spectrometer comprising:

an ion source that ionizes a sample and an internal standard having a known concentration;

an ion trap that accumulates sample ions and internal standard ions at the same time which are generated by the ion source, and separately mass-selectively ejects the accumulated internal standard ions where the sample ions have been accumulated in the ion trap and thereafter, dissociates and mass-selectively ejects the accumulated sample ions each time the sample ions and internal standard ions are accumulated in a measurement sequence of the ion trap;

a detector that detects ions ejected from the ion trap;

an open/close mechanism that introduces the ions into the ion source or the ion trap; and a control unit configured to control the ion trap and the open/close mechanism, and calculate a concentration of the sample on the basis of an intensity of the detected internal standard ions and an intensity of detected fragment ions of the sample ions which are accumulated in the ion trap at the same time in a measurement sequence of the ion trap.

9. The mass spectrometer according to claim 8, wherein the control unit is configured to control the internal standard ions to be ejected from the ion trap in a state where the sample ions and the internal standard ions which are generated by the ion source are accumulated in the ion trap at the same time, and thereafter controls the precursor ions of the sample ions to be isolated and dissociated.

10. The mass spectrometer according to claim 8, further comprising a vaporizer that gasifies the sample and the internal standard, wherein the open/close mechanism is disposed between the vaporizer and the ion source.

11. The mass spectrometer according to claim 8, wherein the ion source includes a flow channel that is made of dielectric and allows gas introduced from the open/close mechanism to flow into the ion trap, and an electrode that is disposed in the flow channel, and an electrode to which an AC voltage is applied.

12. The mass spectrometer according to claim 8, wherein the open/close mechanism is disposed between the ion source and the ion trap.

13. The mass spectrometer according to claim 8, wherein the control unit is configured to control the intensity ratio of the internal standard ions to the dissociated ions of the sample, and the constant determined according to the concentrations of the internal standard ions and the dissociated ions, which are acquired according to the internal standard of the known concentration and the sample, and qualifies the concentration of the sample according to the constant.

14. The mass spectrometer according to claim 8, wherein the open/close mechanism conducts intermittent open/close operation.

* * * * *